United States Patent [19]

Lundström et al.

[11] 4,100,402

[45] Jul. 11, 1978

[54] KEYBOARD KEY WITH CHANGEABLE INDICIA

[75] Inventors: Göran Lundström, Enskede; Willem Huijsers, Farsta, both of Sweden

[73] Assignee: Hugin Kassaregister AB, Stockholm, Sweden

[21] Appl. No.: 743,632

[22] Filed: Nov. 22, 1976

[51] Int. Cl.[2] ..... G06C 7/02; B41J 5/16

[52] U.S. Cl. ..... 235/145 R; 400/490

[58] Field of Search ..... 235/145 R, 146; 197/102, 103, 104, 98; 40/319

[56] References Cited

U.S. PATENT DOCUMENTS

| | | | |
|---|---|---|---|
| 722,006 | 3/1903 | Fox | 197/102 |
| 2,484,886 | 10/1949 | Henry | 197/102 |
| 3,648,394 | 3/1972 | Hepner | 197/102 |

FOREIGN PATENT DOCUMENTS

| | | | |
|---|---|---|---|
| 870,030 | 11/1941 | France | 235/145 R |
| 2,021,112 | 11/1970 | Fed. Rep. of Germany | 235/145 R |

*Primary Examiner*—Stephen J. Tomsky
*Attorney, Agent, or Firm*—Darby & Darby

[57] ABSTRACT

A key in a keyboard for programmable computers, having its farther end recessed to form a nail-sparing shelf for carrying an exchangable mark or indicia. According to the invention the shelf serves as a seat for a flat and transparent pocket for receiving a removable lable carrying said mark, and having its insert opening blocked by the inner edge of the shelf.

3 Claims, 3 Drawing Figures

KEYBOARD KEY WITH CHANGEABLE INDICIA

The present invention refers to a key in a keyboard for programmable computers and carrying an exchangable indicia mark for a particular program element, the end portion of the key remote from the operator being recessed to form a nail-sparing shelf.

The deliverers of computers provided with keyboards, as is the case with cash registers, data terminals or other data equipments, have to, as determined by the application field and the requests of the consumer, coordinate the marks of the keys with the respective desired operations in a program.

Until now this has, as a rule, been effected by providing each key with a movable hood having on its upper side an individual mark. This arrangement, however, increases the touch surface of the key considerably which, on one hand, puts a limit to the density in the positioning of the keys on the board and, on the other hand, reduces the possibility for the nails to escape the touch surface. Further, the mark is subjected to wear so that it, as the time goes by, will be difficult to read. This drawback is not eliminated by placing the mark on the inside of the hood as scratches - primarily produced by the nails - rather soon will obscure the underlying mark.

The disadvantages stated above are eliminated by using the shelf as a seat for a removable marking plate comprising a transparent pocket having its insert opening blocked by the inner edge of the shelf and adapted to house an exchangable lable carrying said mark, the plate having a thickness to place its upper side at a level substantially free from nail touch.

Figure 1:
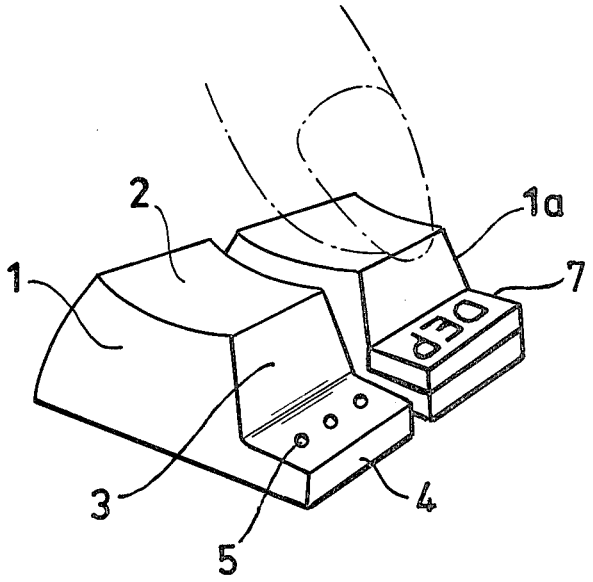
Figure 2:
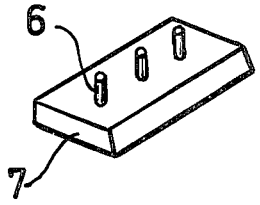
Figure 3:
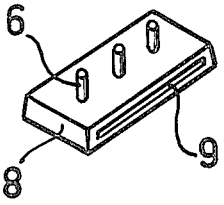

The invention is described in more detail below while referring to the accompanying drawing, where FIG. 1 shows a perspective view of two keys according to the invention, one complete with the indicia plate, and FIGS. 2 and 3 two different embodiments of the completing detail of the indicia plate for the key, shown upside down for illustrative purposes.

The key body 1 may generally be considered as a conventional key with the simple but effective modification that the touch surface 2 has been shortened by providing the front recess 3. The shortening is per se no disadvantage. On the contrary, a collision between the operator's nails and the touch surface is more easily avoided, as is suggested by dash-and-dot lines at the farther key 1*a*.

In the base shelf 4 of the key 1 formed by the recess 3, bores 5 are provided for receiving corresponding pins 6 (FIGS. 2 and 3) on plates 7 and 8, respectively. These plates, which are shown in upside down position for demonstrating the pins 6, are intended to carry the individual marks of the keys. If the mark — in this case e.g. DEP - is of a standard type, it can be printed or ingraved on the flat bottom side (normally the upper side) of the plate 7 in FIG. 2. The key 1*a* is an example of this arrangement. If the mark deviates from standard, the plate 8 in FIG. 3 may be used. This plate is generally a flat pocket of a transparent material, as a plastic. The opening of the pocket shown at 9 is adapted for receiving a label having the desired mark. It should be observed that the pocket in its position turned right way brings its opening 9 to abutment against the inner edge of the shelf, so that the label is blocked from sliding out. The inner edge of the plates may preferably be bevelled, as shown in FIGS. 2 and 3, to obtain a full conformance to the slanting surface of the recess 3. Also, a combination of plates according to FIGS. 2 and 3 on one and the same key board may be contemplated.

An essential advantage is also that, due to the conventional broadening of the key towards the base in combination with the placing of the mark adjacent said base, a maximum space for the mark in the longitudinal direction thereof is secured.

Thus, by the invention easily movable and spacious marks having a protected position is obtained without restricting the closeness of the positioning of the keys.

Various modifications are possible within the scope of the invention, especially as regards the arrangement for an easily releasable engagement between the plate and the key shelf. Of course, the concepts of the invention are applicable also for other shapes of the key than shown, e.g. round buttons.

What is claimed is:

1. A key for a keyboard comprising:

a main body portion adapted to be contacted by the operator, the end of the body portion remote from the operator formed with a rear wall defining a recess into which the nail of the operator can extend and terminating in a shelf, an indicia holding plate mountable on said shelf having a pocket for accepting and holding a label with indicia thereon and an opening into said pocket to permit the label to be exchanged, the top of said plate being transparent to permit the indicia to be viewed, and mating means on said plate and said shelf for mounting the plate to the shelf.

2. A key for a keyboard as in claim 1 wherein the opening into the pocket of said plate is blocked by the rear wall of the key main body portion when the plate is mounted to the shelf.

3. A key as in claim 2 wherein the mating means for mounting the plate to the shelf comprises pins extending from the lower face of the plate and bores on said shelf for receiving the pins.

* * * * *